United States Patent [19]

Degli et al.

[11] Patent Number: 4,767,057

[45] Date of Patent: Aug. 30, 1988

[54] SPRAY NOZZLE

[75] Inventors: Gérard Degli, Uriage; Roger Tholomé, La Tronche, both of France

[73] Assignee: Sames S.A., Meylan, France

[21] Appl. No.: 16,408

[22] Filed: Feb. 19, 1987

[30] Foreign Application Priority Data

Feb. 28, 1986 [FR] France ..... 8602801

[51] Int. Cl.[4] ..... B05B 1/28

[52] U.S. Cl. ..... 239/296

[58] Field of Search ..... 239/290, 296, 297, 298, 239/299, 300

[56] References Cited

U.S. PATENT DOCUMENTS

| | | | |
|---|---|---|---|
| 2,070,696 | 2/1937 | Tracy | 239/296 |
| 2,646,314 | 7/1953 | Peeps | 299/140.1 |
| 3,252,657 | 5/1966 | Winegar | 239/296 |
| 4,219,157 | 8/1980 | Binoche | 239/296 |
| 4,232,824 | 11/1980 | Binoche | 239/296 |

FOREIGN PATENT DOCUMENTS

| | | |
|---|---|---|
| 2809652 | 9/1978 | Fed. Rep. of Germany . |
| 1474549 | 3/1967 | France . |

*Primary Examiner*—Andres Kashnikow
*Assistant Examiner*—Karen B. Merritt
*Attorney, Agent, or Firm*—Sandler and Greenblum

[57] ABSTRACT

A spray nozzle comprises a liquid passage, spray air passages adapted to create a divergent jet of sprayed liquid and shaping air passages for shaping this jet. The shaping air passages include first passages having axes coplanar with the liquid passage. They converge to form a divergent flattened jet coplanar with the liquid passage and having a median plane perpendicular to the plane containing the axes of the first passages and the liquid passage. The shaping air passages also include second passages having axes disposed symmetrically to each side of the aforementioned plane and directed towards the aforementioned median plane.

9 Claims, 1 Drawing Sheet

SPRAY NOZZLE

BACKGROUND OF THE INVENTION

1. Field of the Invention

The invention concerns a device for spraying liquids, especially paint and varnish, and is more particularly concerned with an improvement to the spray nozzle of a device of this kind that makes it possible to obtain under all circumstances improved shaping of the jet of sprayed liquid in a relatively broad fan shape, more particularly for a relatively low flowrate of the liquid.

2. Description of the Prior Art

There is a known liquid spray device using compressed air to spray the liquid and to give the resulting jet the required shape, that of a relatively flat fan, for example. A device of this kind is described in U.S. Pat. No. 2,646,314 and comprises a nozzle equipped with an axial liquid ejection passage, an air ejection passage that is annular, for example, and coaxial with the liquid ejection passage, oblique spray air ejection passages which converge downstream of the liquid ejection passage orifice and shaping air ejection passages the ejection axes of which lie in a plane including the axis of the liquid ejection passage. These latter passages converge towards the front of the nozzle so as to "flatten" the divergent jet of sprayed liquid and thus give it the required shape of a relatively flat fan having an approximately oblong transverse cross-section. The various air ejection passages are generally fed by two compressed air supplies, one for the shaping air ejection passages and the other for the other passages. The pressure of the first supply essentially serves to control the width of the fan while that of the second supply serves to control the fineness of the spray.

Another important parameter to be taken into account is the flowrate of the liquid. A proper choice of the number, diameter, respective positions and orientations of the various passages, in combination with the air pressures chosen, makes it possible to obtain satisfactory results for a specific range of flowrates. However, the adjustments are somewhat delicate since the actions of all the air jets interfere with each other.

It is particularly difficult to obtain a wide jet (meaning, for example, a very broad fan from 50 to 60 cm wide at a distance of 25 to 30 cm from the nozzle) with a low liquid flowrate (typically from 100 to 200 $cm^3$ per minute). Under such circumstances, and depending on the adjustments, the problems experienced with spraying include: a jet that is too narrow, or hollow at the center, or even divided into two parts, in the vicinity of the aforementioned plane in which the axis of the liquid ejection passage is situated, or non-homogeneous spraying, specifically coarse spraying at the edge of the jet. These phenomena are attributed to the fact that at low liquid flowrates the spray air pressure has to be reduced with the result that the jet is no longer able to "resist" the action of the shaping air jets, which are necessarily violent to obtain a broad jet, despite the most appropriate choice of diameters for the various air ejection passages. A specific objective of the present invention is to overcome this problem.

SUMMARY OF THE INVENTION

The present invention consists in a spray nozzle comprising a liquid passage, spray air passages adapted to create a divergent jet of sprayed liquid and shaping air passages for shaping said jet, said shaping air passages comprising first passages having axes substantially coplanar with an axe of said liquid passage conveying to form a divergent flattened jet substantially including said liquid passage axe and having a median plane substantially perpendicular to the plane containing said axes of said first passages and said liquid passage and second passages having axes disposed symmetrically to each side of said plane and directed towards said median plane.

As a general rule the aforementioned first passages are formed in horns of the nozzle projecting parallel to the axial direction of liquid ejection and their orifices discharge onto the facing inside surfaces of the horns.

In a preferred embodiment of the invention the aforementioned second passages are also disposed in these horns and discharge onto the same inside surfaces, downstream of the orifices of the first passages relative to the jet propagation direction.

The invention will be better understood and other advantages of the invention will emerge more clearly from the following description of one embodiment of a device in accordance with the invention given by way of example only and with reference to the appended drawing.

DESCRIPTION OF THE PREFERRED EMBODIMENT

Figure 1:
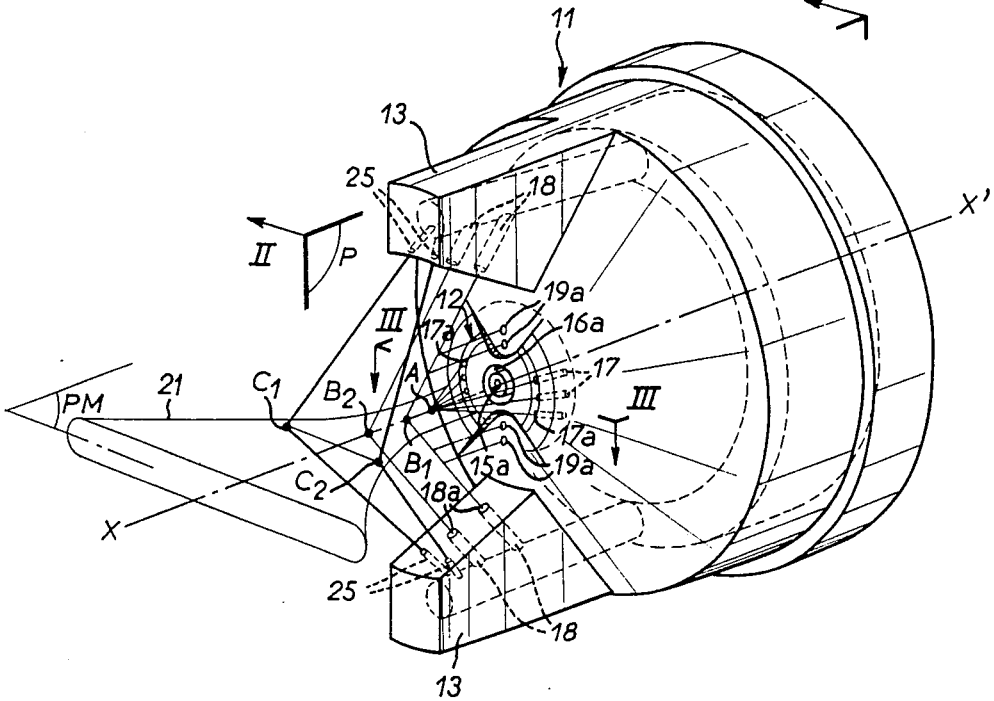
FIG. 1 is a general view in perspective of the nozzle of a liquid sprayer device in accordance with the invention.

Referring to the drawing, there is shown the approximately cylindrical spray nozzle 11 of a compressed air sprayer device in which are various passages discharging through corresponding orifices onto a circular surface 12 of the nozzle or onto the inside surfaces of two parallel horns 13 projecting from the sides of the circular surface 12.

Figure 2:
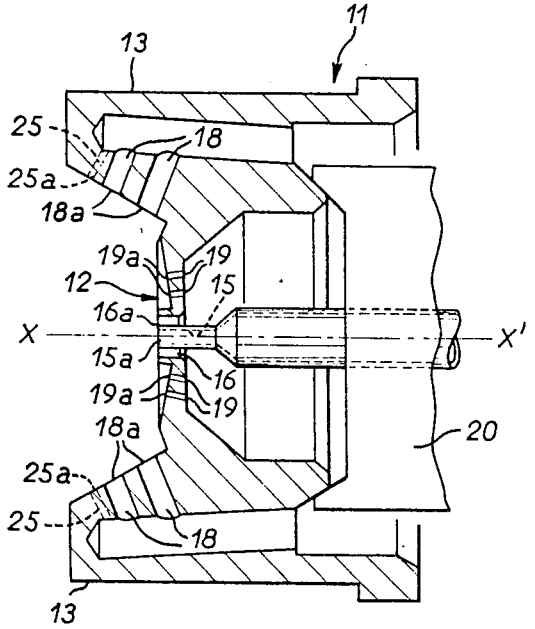
FIG. 2 is a view in axial cross-section on the line II—II in FIG. 1.
Figure 3:
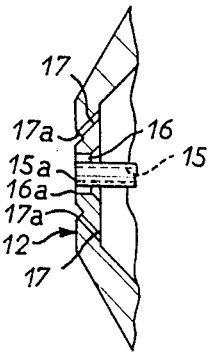
FIG. 3 is a partial cross-section on the line III—III in FIG. 1.

In a way that is known per se, the nozzle 11 comprises the following passages:

- an axial liquid ejection passage 15 discharging through an orifice 15*a* at the center of the circular surface 12, the liquid ejection axis being the axis marked X'X on the drawing;
- an annular cross-section feed air ejection passage 16 coaxial with the passage 15 and discharging through an annular orifice 16*a* onto the circular surface 12;
- spray air ejection passages 17 oblique to the axis X'X and having ejection axes that converge at a point A on this axis, downstream of the orifice 15*a* relative to the liquid ejection direction, the orifices 17*a* of these passages also discharging onto the surface 12;
- first shaping air ejection passages 18 in the horns 13, oblique to the axis X'X and arranged in pairs substantially situated in a predetermined plane P containing this axis; the orifices 18*a* of said first passages discharge onto the facing surfaces of the horns 13 and the axes of these passages converge in pairs on the axis X'X at points $B_1$, $B_2$, etc. spaced along this axis downstream of the point A (the previously mentioned plane P is also the cross-section plane of FIG. 2);

air ejection passages 19 situated in the same plane P as the passages 18 and the orifices 19*a* of which discharge onto the circular surface 12: the air jets from these passages prevent splashes of the sprayed liquid being desposited on the horns 13 and also slightly "flatten" the air jets from the orifices 18*a*, which helps to prevent these hollowing out or splitting the jet in the vicinity of the plane P.

In the conventional way the passages 18 are fed by one compressed air supply and the passages 16, 17 and 19 are fed by another compressed air supply so that the adjustments described above can be made. The pipe sections feeding these two groups of passages are separated by an annular member 20 which also serves to center the axial conduit in which the passage 15 is defined.

The plane PM comprisng the axis X'X and perpendicular to the plane P is defined as being the required median plane of the fan-shaped jet 21 of sprayed liquid.

To these arrangements that are known per se the invention adds second shaping air ejection passages 25 in the horns 13, to either side of the plane P containing the passages 18. The orifices 25*a* of these second passages discharge onto the facing surfaces of the horns 13 and the ejection axes of these passages are oriented symmetrically on either side of the plane P towards the median plane PM. There are two pairs of second passages 25 the ejection axes of which converge in pairs at points $C_1$, $C_2$ substantially in the median plane PM, to either side of the axis X'X and downstream of the points convergence $B_1$, $B_2$ of the ejection axes of the first passages 18.

The first passages 18 in each horn 13 are substantially parallel and the two second passages 25 in the same horn, situated in a common plane to either side of the plane P, are themselves in a plane substantially parallel to the axial direction of a passage 18 formed in the same horn. If the passages 18 were not parallel, then the plane of the passages 25 would advantageously be substantially parallel to the axis of the nearest passage 18. The plane containing the second passages 25 of the same horn is at an angle of approximately 68° to the axis X'X. Also, the second passages of each horn are at an angle of approximately 36° to each other. Their orifices 25*a* are situated approximately 2 mm downstream of the orifice of the or the nearest first passage of the same horn. The orifices 25*a* of the two second passages in the same horn are preferably approximately 2 mm apart.

The second passages all have the same diameter which is less than that of the first passages. The diameter of the second passages 25 is preferably substantially equal to the diameter of the spray air ejection passages 17 or that of the passages 19.

In the example described, this diameter is approximately 0.5 mm. It is to be understood, however, that all the numerical values just given are purely indicative and correspond to a specific embodiment from which good results have been obtained. Numerous other combinations of diameter and orientation of the passages are possible.

The second passages 25 directing jets of air onto the sides of the fan-shaped jet 21 have a two-fold role. On the one hand, they contribute to the "flattening" of the jet of sprayed liquid and thus to widening the fan-shaped jet 21.

Also, by impelling the sprayed liquid towards the center of the jet the air jets from the passages 25 contribute to "filling in" any hollow space that might be created in the vicinity of the axis X'X by the air jets from the passages 18. Thus the cross-section of the fan-shaped jet 21 is much closer to the required oblong cross-section.

We claim:

1. Spray nozzle comprising a liquid passage, spray air passages adpated to create a divergent jet of sprayed liquid and shaping air passages for shaping said jet, said shaping air passages comprising first passages having axes subtantially coplanar with an axis of said liquid passage converging to form a divergent flattened jet substantially including said liquid passage axis and having a median plane substantially perpendicular to the plane containing said axes of said first passages and said liquid passage, and at least two pairs of second passages, each of said second passages having axes disposed symmetrically to each side of said plane and directed toward said median plane, with the passages of each pair disposed one on each side of said median plane, and wherein the axes of said second passages converge in pairs substantially in said median plane to either side of said liquid passage and downstream of said axes of said first passage relative to the propagation direction of said jet.

2. Spray nozzle according to claim 1, comprising two horns projecting parallel to the axis of said liquid passage and in which said first and second passages are formed.

3. Spray nozzle according to claim 2, wherein said second passages in each horn are in a plane substantially parallel to the axis of a first passage in the same horn.

4. Spray nozzle according to claim 3, wherein said plane is at an angle of substantially 68° to the axis of said liquid passage.

5. Spray nozzle according to claim 3, wherein said second passages in each horn are at an angle of approximately 36° to each other.

6. Spray nozzle according to claim 3, wherein said first and second passages have respective outlet orifices and said outlet orifices of said second passages are approximately 2 mm downstream of said outlet orifice of the or the nearest first passage in the same horn.

7. Spray nozzle according to claim 6, wherein said orifices of said second passages in each horn are approximately 2 mm apart.

8. Spray nozzle according to claim 1, wherein the diameter of each second passage is substantially equal to the diameter of said air passages.

9. Spray nozzle according to claim 1, wherein the diameter of each of said second passages is approximately 0.5 mm.

* * * * *